US012448793B2

(12) United States Patent
Terstriep

(10) Patent No.: US 12,448,793 B2
(45) Date of Patent: Oct. 21, 2025

(54) SCREED RAIL SYSTEM FOR POURING CONCRETE AGAINST A WALL

(71) Applicant: Dragon Screed LLC, Quincy, IL (US)

(72) Inventor: Luke Terstriep, Quincy, IL (US)

(73) Assignee: Dragon Screed, LLC, Quincy, IL (US)

( * ) Notice: Subject to any disclaimer, the term of this patent is extended or adjusted under 35 U.S.C. 154(b) by 925 days.

(21) Appl. No.: 17/670,409

(22) Filed: Feb. 11, 2022

(65) Prior Publication Data

US 2022/0251859 A1 Aug. 11, 2022

Related U.S. Application Data

(60) Provisional application No. 63/148,465, filed on Feb. 11, 2021.

(51) Int. Cl.
*E04G 21/10* (2006.01)
*E04F 21/24* (2006.01)

(52) U.S. Cl.
CPC ..... *E04G 21/10* (2013.01); *E04F 21/241* (2013.01)

(58) Field of Classification Search
CPC ..... E04G 21/10; E04F 21/241; E04C 5/16
USPC ..... 404/118, 135, 136
See application file for complete search history.

(56) References Cited

U.S. PATENT DOCUMENTS 1,284,734 A * 11/1918 Mailanen ..... E04F 13/045 404/136
2,281,946 A * 5/1942 O'Neill, Jr. ..... E01C 23/01 52/678
2,319,526 A * 5/1943 Wearn ..... E01C 19/502 52/678
3,006,115 A * 10/1961 Hillberg ..... E04F 21/05 52/678
3,115,726 A * 12/1963 Sayles ..... E04F 21/05 404/136
3,289,379 A * 12/1966 Watts ..... E04C 5/20 52/39
4,158,937 A * 6/1979 Henry ..... E04F 21/241 52/367
4,913,582 A * 4/1990 Barrett ..... E01C 23/01 52/378
5,491,941 A * 2/1996 Lancelot, III ..... E04C 5/163 52/223.14
5,586,416 A * 12/1996 Hess, III ..... E02D 27/013 52/169.5
6,178,716 B1 * 1/2001 Chen ..... E04C 5/20 404/136
6,866,445 B2 * 3/2005 Semler ..... E04F 21/04 52/678
7,086,203 B2 * 8/2006 Owen ..... E01C 23/01 404/136
8,397,442 B2 * 3/2013 Laurin ..... E02D 27/32 52/126.6
10,896,774 B2 * 1/2021 Stilwell ..... H02G 3/30
2002/0088315 A1 * 7/2002 Thurman ..... B25B 13/50 81/176.15

(Continued)

*Primary Examiner* — Raymond W Addie
(74) *Attorney, Agent, or Firm* — Robinson & Cole LLP

(57) ABSTRACT

A concrete screeding apparatus for a wall captured concrete pour includes a round screed rail with a top edge that defines the level of the screeded concrete, and a stake base assembly with a rail support for holding the screed rail. A rebar stake is driven into the soil through the stake base assembly, and a rail support sits atop the rebar stake.

13 Claims, 7 Drawing Sheets

(56) References Cited

U.S. PATENT DOCUMENTS

2004/0163334 A1* 8/2004 Carlson ..... E04G 25/06
52/126.6

* cited by examiner

SCREED RAIL SYSTEM FOR POURING CONCRETE AGAINST A WALL

CROSS-REFERENCE TO RELATED APPLICATIONS

The present application claims priority from, and incorporates by reference in its entirety, U.S. provisional patent application 63/148,465 filed Feb. 11, 2021.

BACKGROUND

Field of the Invention

The present invention relates to construction equipment, and more particularly, to construction equipment to aid in pouring concrete into forms.

Description of Related Art

FIG. 1A depicts a top view of a concrete pour against a wall 102 using a conventional screed rail 151. Such a situation might take place when pouring a strip of concrete up against the side of a garage or other building. When pouring concrete up against a wall 102, building or other obstacle, only one concrete form 104 can be used—the outside form 104 away from the wall 102. The wall 102 serves as the other form to hold the wet concrete slurry. To screed the wet concrete and ensure a level (or straight) surface the screed bar 106 needs to be supported near the wall 102 for the screeding process. The conventional approach is to use a screed rail 151 placed in the wet concrete that does not extend all the way to the bottom of the pour. The outside form 104 extends all the way to the ground, serving as a boundary edge for the wet concrete. But screed rail 151 positioned a short distance from wall 102 extends only two or three inches into the concrete. The screed rail 151 temporarily placed in the wet concrete allows screeding with the screed bar 106 by a worker positioned outside of concrete form 104 (i.e., to the right of form 104 in the figure).

FIG. 1B depicts a perspective view of the conventional screed rail 151 shown in FIG. 1A. According to the conventional method, wooden stakes 108 are driven into the ground deep enough to provide support to the conventional screed rail 151. A thick piece of flat iron is typically used as a conventional screed rail 151 to minimize the width of interference in the newly poured and screeded concrete. For example, many contractors use a 3-inch wide (or sometimes a 2-inch wide) piece of flatiron with a thickness of at least ¼ inch. FIG. 1C depicts an end view of two conventional structures on wooden stakes 108 for holding the conventional flatiron screed rail 151 on edge. The most common way of holding conventional flatiron screed rails 151 on the stakes 108 is to use a pair of nails driven into the top of each stake 108, with one nail on either side of the flatiron. Some contractors use stakes with notches cut into the top of them for holding the conventional flatiron screed rail 151 in place. The conventional flatiron screed rail 151 must be held on edge on top of the wooden stakes 108 in order for it to provide enough structural support for the screed bar 106. Such a conventional flatiron screed rail 151, if held in the upright position, is sturdy enough to support the screed bar 106 while screeding the freshly poured concrete to level, smooth and finish its surface.

After screeding is finished the conventional flatiron screed rail 151 is pulled out. It is generally too difficult to find and remove the stakes 108 from the wet concrete, so they are left in the concrete as it hardens. Since the stakes 108 are left a couple inches below the finished surface of the concrete, they are never seen. Conventional screed rails 151 are made from flatiron—e.g., a 3" wide or 2" wide strip of 0.25" thick flatiron—because the thin flatiron leaves a relatively narrow gap when removed from the wet concrete. The narrow gap left upon pulling conventional screed rail 151 out of the wet concrete can be filled in by floating the concrete surface from outside of form 104 with a concrete float or other tool for finishing the concrete surface.

BRIEF SUMMARY OF THE INVENTION

An inner screed rail is a screed rail that is temporarily positioned in the wet concrete a short distance from a wall or other barrier to provide support for a screed bar during the screeding process. The inner screed rail is removed from the wet concrete upon completion of screeding with the screed bar.

DESCRIPTION OF THE DRAWINGS

The accompanying drawing, which is incorporated in and constitutes part of the specification, illustrate various embodiments of the invention. Together with the general description, the drawings serve to explain the principles of the invention. In the drawings.

DETAILED DESCRIPTION

Figure 1A:
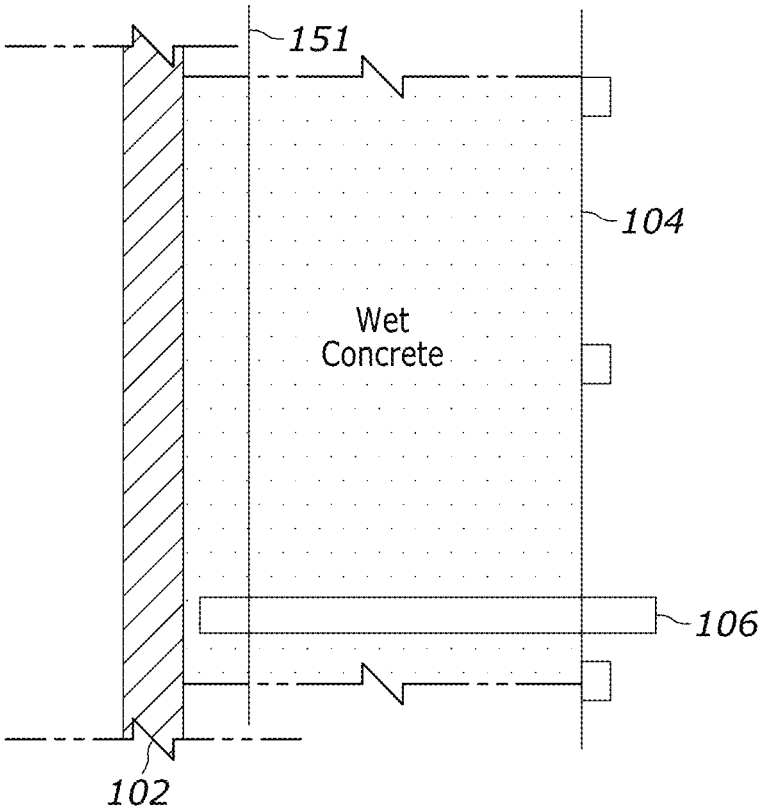
Prior Art FIG. 1A
FIG. 1A is a top view depicting a concrete pour using a conventional flatiron screed rail.

A wall captured concrete pour occurs when concrete is poured between a concrete form on one side and a barrier such as a wall on the other side—e.g., form 104 and wall 102 of FIG. 1A. The wall or other barrier is used as a concrete form to capture the poured concrete, but can't be used as a screed rail to support a screed bar. The present inventor recognized a number of drawbacks and issues with conventional flatiron screed rails used for wall captured concrete pours. For example, once the screeding has been completed and the screed rail is no longer needed the screed rail is pulled out of the wet concrete. The disturbance to the surface of the wet concrete is then floated out and smoothed over. Conventional flatiron screed rails tend to cut down into the wet concrete due to their shape. Although the narrow cut from a conventional flatiron screed rail is easy to float in, the present inventor recognized that the process of floating in the cut results in concrete which is mostly mortar with little sand or gravel content. This tends to weaken the concrete slab along the line where the conventional flatiron screed rail was pulled out.

Figure 1B:
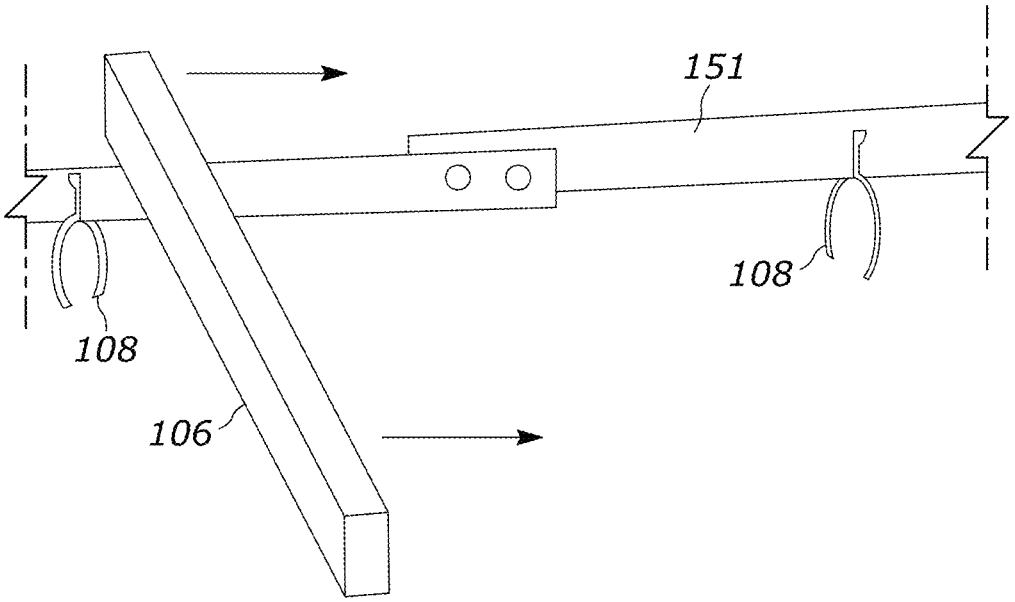
Prior Art FIG. 1B
FIG. 1B is a perspective view depicting a conventional flatiron screed rail.

Another drawback occurs because the lifting of a conventional flatiron screed rail up out of the wet concrete sometimes causes it to twist or flop over onto the wet concrete surface due to the force required to pull it out. This is especially true if the piece of flatiron being used as a screed is more than ten or twelve feet long. FIG. 1B shows two pieces of flatiron bolted together to form a conventional screed rail. However, as a practical matter the two flatiron pieces cannot be much longer than ten or possibly twelve feet in length. A length of flatiron screed rail longer than this would be likely to buckle while pulling it out of the wet concrete, putting a kink in the conventional screed rail which would require repair before it could be used for screeding again.

The greatest disadvantage of conventional screed rails noted by the present inventor may be that a conventional screed rail generally requires one or even two workers to walk into the wet concrete to remove it. A conventional flatiron screed rail cannot easily be removed from wet concrete by workers who remain outside the forms 104. The workers' footprints made in the wet concrete when removing the conventional flatiron screed rail cause considerable damage to the freshly screeded wet concrete surface and must be repaired before moving on to the next section of the pour. The various embodiments disclosed herein overcome these disadvantages.

One final disadvantage of conventional screed rails systems has to do with the wooden stakes 108 that are used. The wooden stakes 108 used in normal conditions are generally around two feet long. However, a two foot long wooden stake 108 driven into wet or muddy soil does not provide sufficient support for the screeding process. The stake 108 should be able to hold up at least 100 pounds or so without sinking into the ground. A conventional stake 108 that sinks a half inch—or even a quarter of an inch—further into the ground during the screeding process will cause an unacceptable amount of error in a concrete pad that is intended to be level. Sometimes muddy ground requires using a wooden stake 108 that is four or five feet long—or even longer—in order to provide the requisite stability. Various embodiments of the present invention overcome this drawback.

Figure 2A:
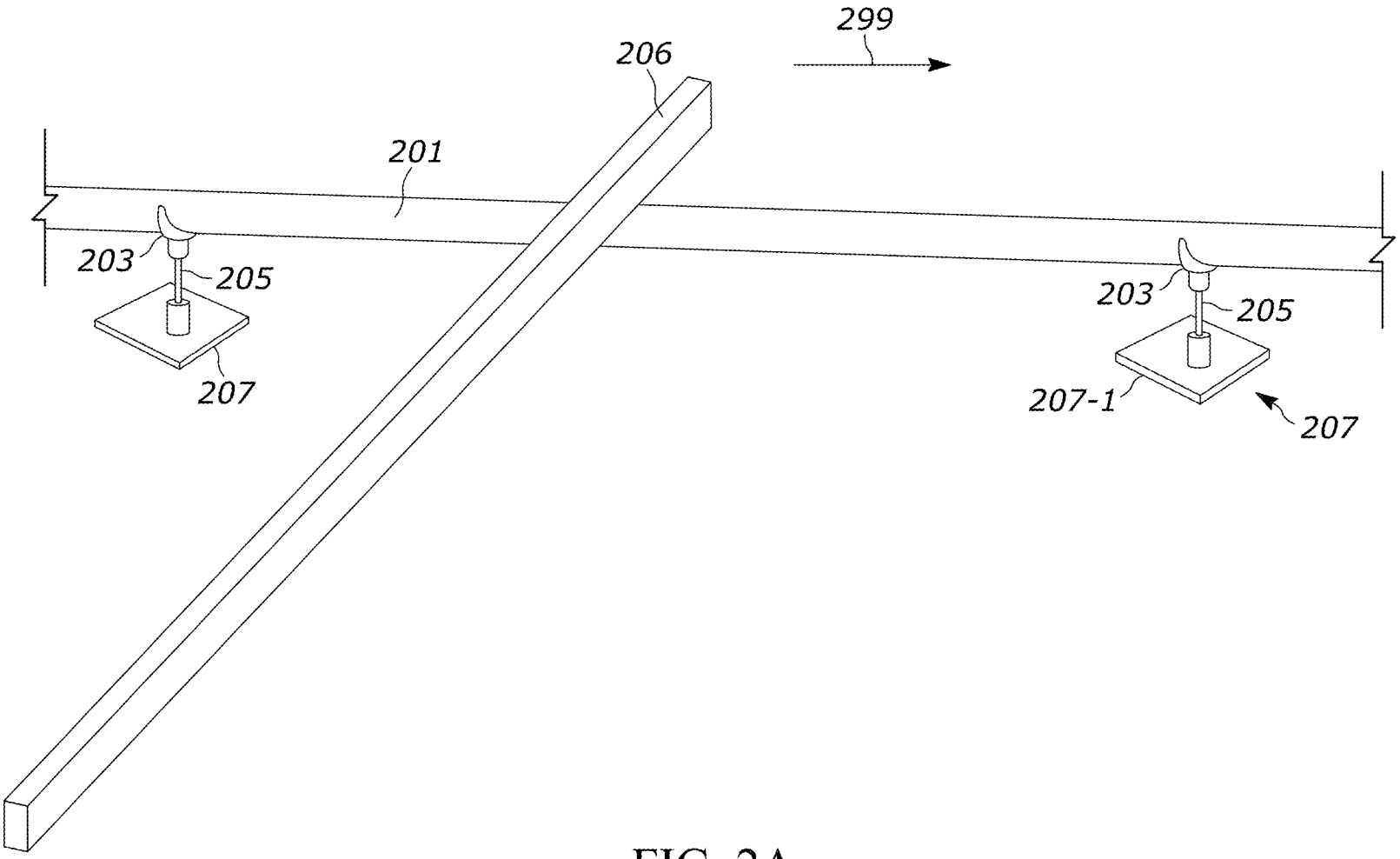
FIG. 2A is a perspective view depicting a screed rail system according to various embodiments.

FIG. 2A is a perspective view depicting a screed rail system according to various embodiments. Unlike the conventional flatiron screed rails 151, the screed rail 201 disclosed herein typically has a round cross-section. Other shaped cross-sections can also be used in various implementations—such as a square, an oval or a triangular screed rail—but a round screed rail meets all the requirements of the various embodiments to overcome the drawbacks of conventional devices. The various shaped cross-sections of screed rail 201 are characterized by a cross-sectional width that is no more than three times greater than the cross-sectional thickness—the width being the largest dimension across the cross-section and the thickness being the dimension across the cross-section perpendicular to the width. The description of the various shapes' cross-sectional widths being no more than three times greater than their cross-sectional thicknesses is provided to distinguish the various shaped cross-sections of screed rail 201 from the conventional flatiron screed rails. Moreover, in addition to being inherently sturdy, the round shape for screed rails 201 is advantageous inasmuch as the material used to make round screed rails is readily available.

The screed rail 201 sits atop of rail support 203. The rail support 203 sits on top of a metal stake 205 which has been driven into the ground. Unlike conventional wooden stakes 108, the metal stake 205 is typically made from rebar material—e.g., 0.5 inch rebar, 0.375 inch rebar or 0.625 rebar—all of which are materials that are commonly available at a concrete pour job site. Conventional wooden stakes 108 left in the concrete tend to weaken the structural integrity of the concrete. Stakes 205, which are typically made from iron rebar material, tend to strengthen the concrete.

To screed a wall captured concrete pour into a finished concrete surface, the screed bar 206 is pushed (or pulled) in the direction 299 of the screed rail 201, often with a back-and-forth sawing motion to work the wet concrete forward. Since the bottom of screed bar 206 is pushed along the top of the screed rail 201, the top edge of screed rail 201 defines the level of the screeded concrete surface. The top edge of screed rail 201 is positioned at the desired level of the concrete pad being poured.

The rail support 203 has an inner surface profile that matches the screed rail 201, allowing rail support 203 to receive the screed rail 201—that is, so that the screed rail 201 can fit into the concave portion (inner surface profile) of rail support 203 as shown in FIG. 2A. The inner surface profile is the cross-section shape of the rail support 203 that holds the screed rail 201. The rail support 203 shown in FIG. 2B has a surface profile that is approximately concave in shape, or U shaped. The arms of the rail support 203 should extend no higher than the top edge of the screed rail 201 so as to avoid having the screed bar 206 bump over the arms and create a ripple in the screeded concrete. In other implementations the rail support 203 has a squared U shape or a triangular V shape rather than a U shape. All the rail support 203 embodiments are shaped to receive the screed rail 201 such that the arms of the rail support 203 do not extend above the screed rail 201's top edge.

Figure 2B:
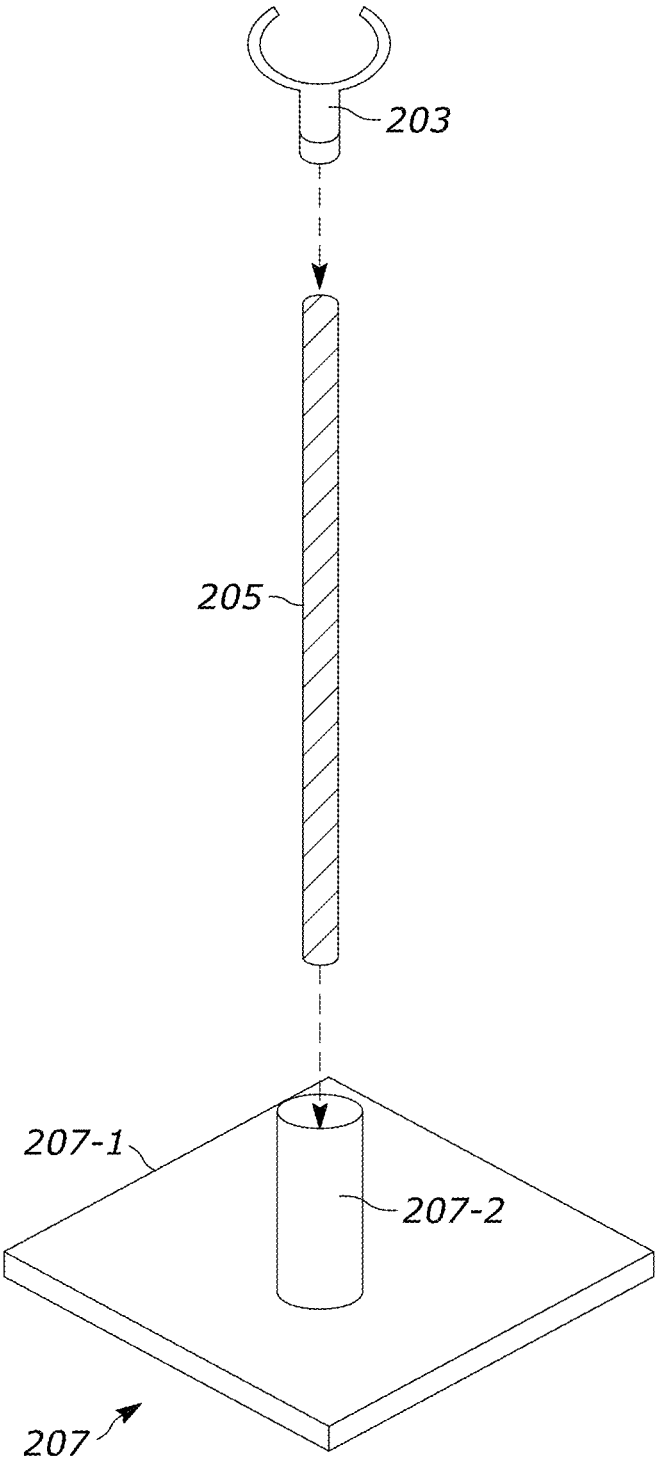
FIG. 2B is a perspective view depicting a stake base assembly, a metal stake and a rail support according to various embodiments.

FIG. 2B depicts a closer perspective view of a stake base assembly 207, a metal stake 205 and a rail support 203, according to various embodiments. The stake base assembly 207 provides further support to the metal stake 205 which is especially useful if the metal stakes 205 are driven into soft or muddy soil. The stake base assembly 207 includes a base plate 207-1 and a stake holder 207-2 (sometimes called a stake cylinder 207-2). The base plate 207-1 may be made from durable plastic polymer, metal, or from any other materials that are sturdy enough to temporarily support the screed rail 201 and screed bar 206 which the concrete is being smoothed as are known by those of ordinary skill in the art. In some implementations the metal stake 205 is driven into the ground through the stake holder 207-2 and the hole in the center of the base plate 207-1. Alternatively, the metal stake 205 may be driven into the ground and the stake base assembly 207 can later be placed on the metal stake 205. In some embodiments the stake holder 207-2 is permanently attached to the base plate 207-1 by welding, gluing or other structures for permanently attaching two items.

The lower surface of base plate 207-1 is configured to sit on ground surface. As used herein, the phrase "ground surface" means the surface that the concrete pour is going over. Quite often the ground surface is actual ground (e.g., soil or rocks), but the ground surface can also be a number of other materials including, for example a waterproof membrane, aggregate (e.g., sand or gravel) poured over the soil to level it and produce a uniform slab thickness, or anything else the concrete pour is going over. The ground surface can even be concrete if the pour is going over a previously poured sidewalk or driveway. In one implementation the base plate 207-1 is square and measures 4"×4" with a half inch hole in the center. For softer soil larger base plates 207-1 may be used, e.g., squares of 6," 8," 10," 12", or other sizes up to four feet in width. Further, various different shaped base plates 207-1 have been implemented as well to accommodate the conditions of the pour location. Base plates 207-1 may be implemented in rectangular, circular, ovals or other shapes. The support provided by the plates 207-1 depends upon the area it covers. A 4" square base plates 207-1 covers 16 square inches, not considering the hole in the center. Allowing one square inch for the hole (which is actually closer to 0.5 square inch), the 4" square plates 207-1 covers at least 15 $in^2$. Various embodiments of the base plates 207-1 have an area of 15 $in^2$ or greater. Other embodiments have an area of 24 $in^2$ or greater, 35 $in^2$ or greater, 63 $in^2$ or greater, and 143 $in^2$ or greater.

In another embodiment the base plate 207-1 does not have a hole through it, and the stake holder 207-2 is permanently attached to the base plate 207-1. A shortened metal stake 205 is placed in the stake holder 207-2 rather than being driven into the ground. This embodiment is useful in situations where a portion of the concrete being poured extends over a rock surface or an existing concrete slab or sidewalk. In such situations a specialized rail support 203 may be used that fits into the stake holder 207-2, without need to use the shortened metal stake 205. In these embodiments the bottom portion of a longer and thinner rail support 203 fits down into the stake holder 207-2 after the appropriate length of the rail support 203 has been trimmed to produce the proper height for the screed rail 201.

Figure 2C:
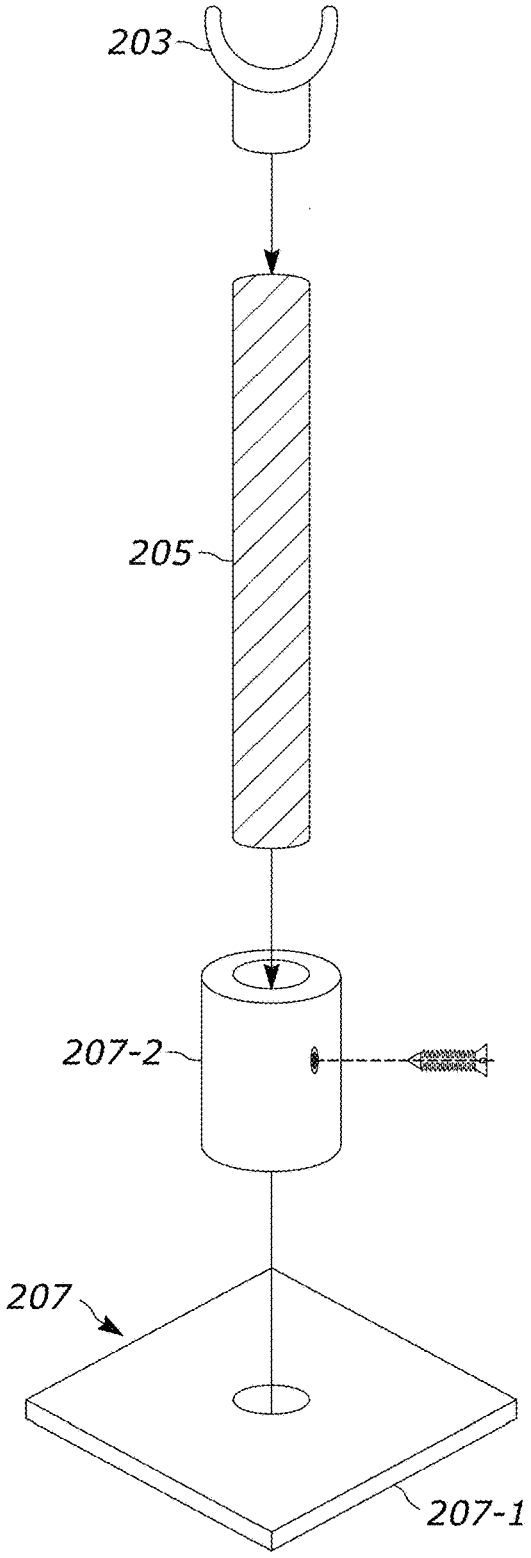
FIG. 2C is a perspective view depicting a stake base assembly, according to various embodiments.

FIG. 2C is a perspective view depicting a stake base assembly, according to various embodiments. In these embodiments the stake holder 207-2 is not attached to the base plate 207-1. The present inventor discovered that the two pieces of the stake base assembly 207 provide ample support for screed rail 201 without being permanently connected to each other. Since, in these embodiments the two pieces are not connected, they can be made from different materials without posing problems in being able to attach them together. For example, in some implementations the stake holder 207-2 is made from metal while the base plate 207-1 is made from a sturdy polymer material, plastic, fiberglass or other type of material known to those of ordinary skill in the art.

Since the stake holder 207-2 and base plate 207-1 are not attached together in these embodiments, they need not be on the metal stake 205 when it is being driven into the ground. The metal stake 205 can be driven into the ground to the appropriate depth, and the stake holder 207-2 and base plate 207-1 can later be placed on the metal stake 205.

Figure 3:
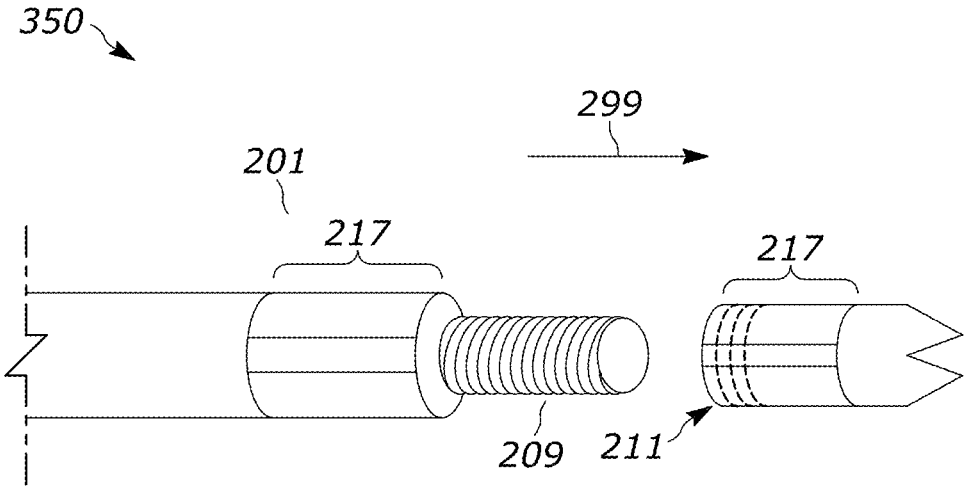
FIG. 3 are perspective views depicting details of the screed rail and stake base, according to various embodiments.
Figure 3:
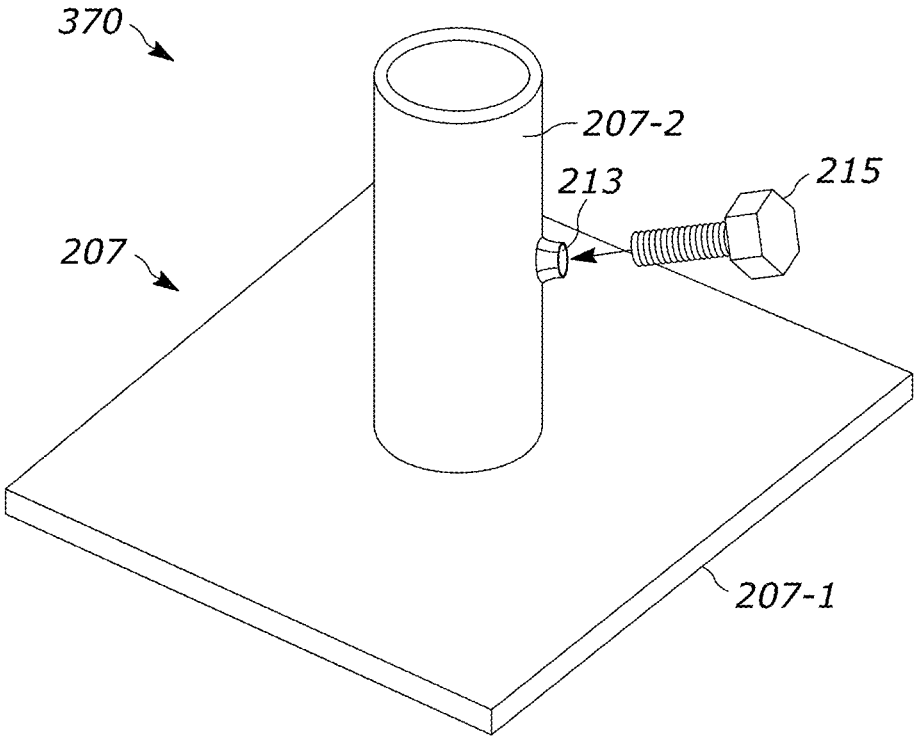

FIG. 3 depicts perspective views to illustrate details of the screed rail 201 and stake base assembly 207, according to various embodiments. Typically, the screed rail 201 is provided in sections that are fastened together to form a longer length that is more convenient to work with than the 10 or 12 foot sections of conventional screed rails. If a forty foot long strip of concrete is being poured, a number of sections can be affixed together to provide a screed rail 201 of at least forty feet or longer. For very long strips of concrete—e.g., a quarter mile driveway—the screed rail 201 can be moved to the section currently being pour.

Figure 1C:
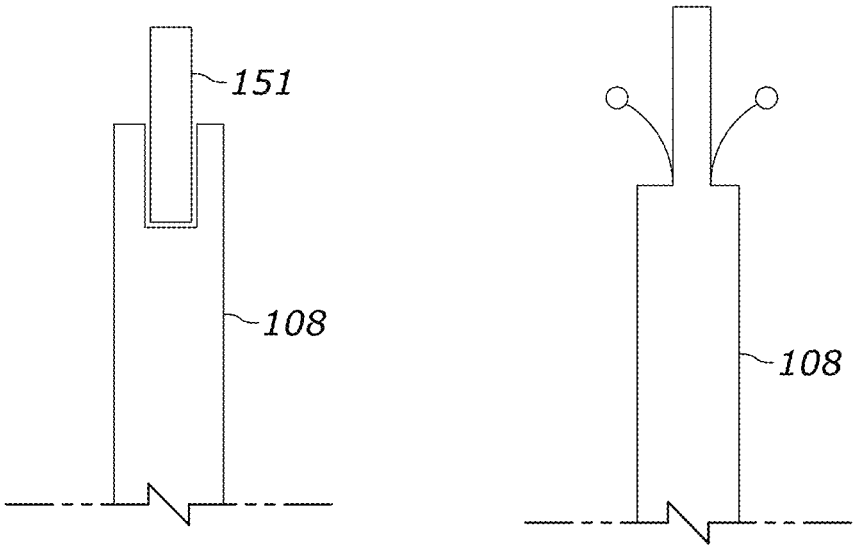
Prior Art FIG. 1C
FIG. 1C depicts two conventional structures for holding the conventional flatiron screed rail on edge on wooden stakes.

Conventional flatiron screed rails such as 151 of FIGS. 1A-C cut down into the wet concrete to a depth of at least two or three inches. An attempt to lift a flatiron screed rail 151 from the end, from a position just past the newly poured wet concrete, would almost certainly cause the flatiron screed rail 151 to buckle. The wet concrete adheres to the flatiron screed rail 151 too much to allow it to be slid along the wooden stakes 108. The various embodiments overcome these drawbacks. The round shaped screed rail 201 depicted in FIG. 3 does not tend to twist or buckle upon being lifted from the wet concrete slurry. This allows a worker standing just past where wet concrete has been pour to lift the round shaped screed rail 201 from the wet concrete and slide it down the line of the pour to the next set of rail supports 203 that will be used. In this way, workers avoid the need to wade out into the wet concrete slurry in order to move the screed rail 201, thus saving considerable time during a concrete pour.

In either case, pouring a concrete strip of much more than a few feet requires that a number of screed rail 201 sections be connected together, then disconnected upon completing the pour so they can be transported back to the shop or to the next job site. The present inventor recognized a drawback in the manner that conventional flatiron screed rails are connected together. The conventional flatiron screed rails are simply sandwiched together, fastening them with two or more bolts at each connection point. This makes them easy to put together and take apart. If aligned properly the overlapped pieces of flatiron produces a flat surface on the top edge where the screed bar rests. However, if the bolt holes have been widened out they might not align properly when fastened together. This can cause a jagged edge of perhaps ⅛ inch or so at the connection point joint of two conventional flatiron screed rails 151. Further, the bolts protrude out of both sides of the joint between two conventional flatiron screed rail 151 sections. The jagged edges at the connection points often catch the screed bar, interfering with the screeding process and sometimes resulting in a small ridge in the finished concrete. The protruding bolts at the joints of conventional flatiron screed rails 151 tend to tear up the concrete when the rail is pulled out. The various embodiments disclosed herein overcome these drawbacks.

View 350 of FIG. 3 shows details of a seamless joint between sections of a screed rail 201 according to various embodiments. A male threaded end 209 is tightened into a female threaded end 211 of the screed rail 201. The threads of male threaded end 209 and female threaded end 211 may be V-point threads, squared threads or Acme threads which fall between V-point and squared threads. Acme threads tend to fit looser than V-point threads, and are less susceptible to binding up if a small amount of impurities get in the threads—e.g., fine sand or concrete slurry. The male and female threads run in the same direction as the screed rail 201—that is, in the direction of line 299 shown in view 350 of FIG. 3. (The bolts used to connect sections of a conventional flatiron screed rail 151 are positioned perpendicular to the direction of the screed rail.) The male threaded end 209 and female threaded end 211 tightened together produces a seamless joint which does minimal damage to the wet concrete surface when the screed rail 201 is pulled to the next pour position after screeding is finished. The threaded male/female connection structure does not tend to loosen up over time like the conventional connections using bolts through bolt holes which tend to widen over time. A hex cross-section portion 217 may be provided on the screed rail 201 to aid in tightening or loosening sections of the screed rail 201 from each other. The screed rail 217 depicted in FIG. 3 is still considered a round cross-section screed rail despite the hex portion 217 since the hex portion 217 typically does not extend out beyond the diameter of the round portion.

Turning to view 370 of FIG. 3, the stake base assembly 207 may include a stake holder 207-2 welded or otherwise connected to a base plate 207-1. In other embodiments the base plate 207-1 and stake holder 207-2 are not attached together, as shown in FIG. 2C. The stake holder 207-2 may be made from a piece of iron pipe with an inner diameter slightly larger than the diameter of the metal stake 205. In embodiments with square stakes\(or other shapes), the stake holder can also have a square cross-section (or other shape) sized to accept the stake.

Various embodiments of the stake holder 207-2 have an attachment mechanism that affixes it to the metal stake 205 in preparation of the screeding process. The embodiment shown in the figure includes a nut 213 welded to the stake holder 207-2 over a hole that exposes the stake. A bolt (or screw) 215 can be used as part of the stake attachment mechanism to attach the stake base assembly 207 to metal stake 205. The bolt 215 is tightened down onto the metal stake 205, attaching the two parts together to provide structural rigidity during the screeding process. In other embodiments the stake attachment mechanism includes a hole in stake holder 207-2 tapped to have threads as shown in FIG. 2C. In such embodiments a bolt 215 is screwed into the threaded hold rather than welding a nut onto the stake holder 207-2. In yet other embodiments of the stake attachment mechanism the metal stake 205 may be attached to the stake holder 207-2 by driving a wedge or nail down into the stake holder 207-2 alongside the metal stake 205. If the stake is not quite lined up correctly, the nail or wedge can be driven on the side of where the screed rail 201 sits to push the metal stake 205 back into line. If the metal stake 205 is lined up properly, the nail or wedge can be driven in line with the screed rail 201 to avoid pushing the metal stake 205 out of alignment. Aside from the welded nut and bolt, the threaded hole and bolt, the nail or wedge, various other forms of stake attachment mechanisms may be used as are known by those of ordinary skill in the art for attaching two components together.

Figure 4:
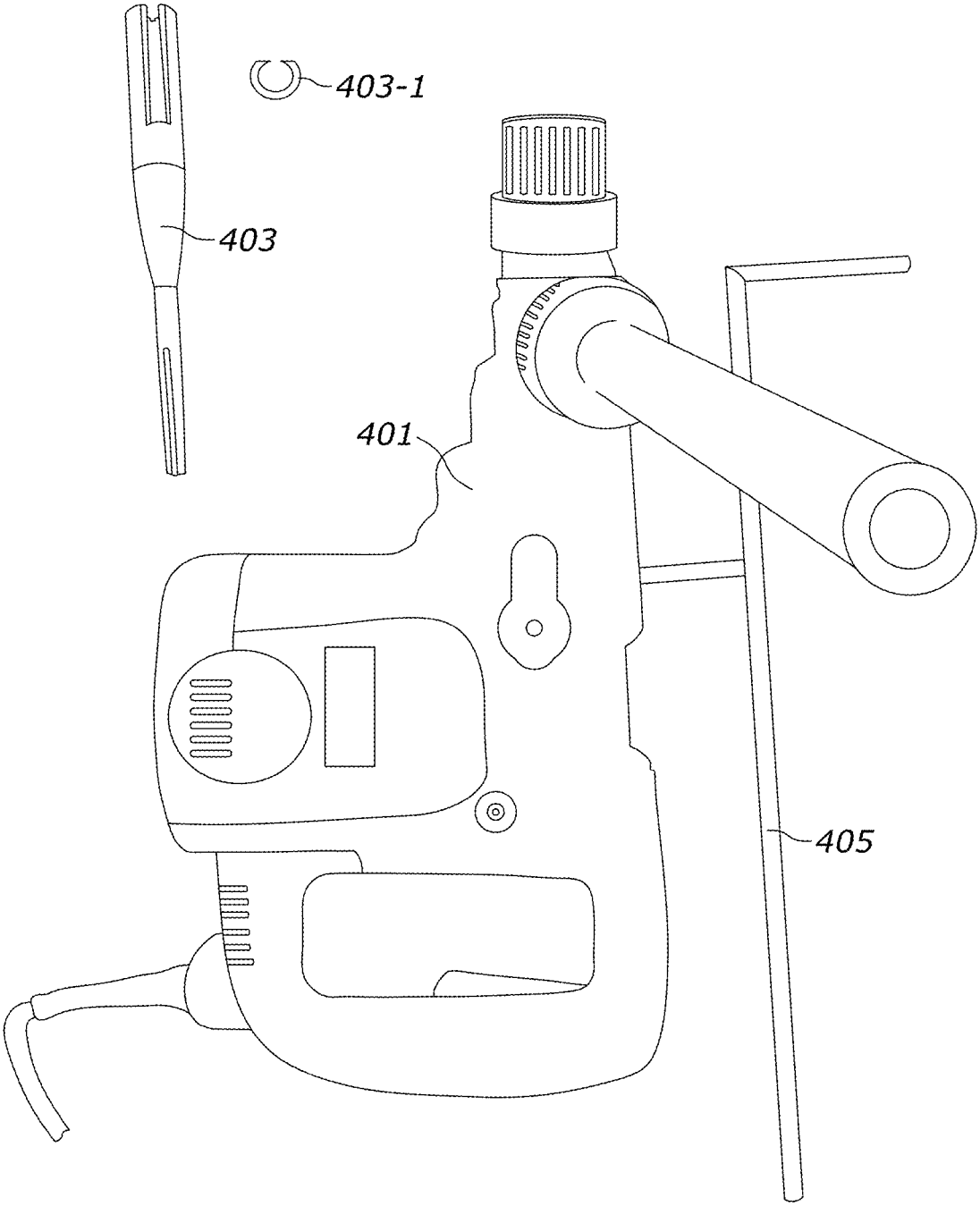
FIG. 4 depicts a stake driver and stake driver attachment, according to various embodiments.

FIG. 4 depicts a stake driver 401 and stake driver attachment 403, according to various embodiments. The stake driver 401 can be embodied as an industrial hammer drill. A stake driver attachment 403 used in conjunction with the industrial hammer drill stake driver 401 rapidly drives the rebar stakes 205 down into the ground to the appropriate depth. The stake driver attachment 403 fits loosely over the end of a metal stake 205. The hole of stake driver attachment 403 that metal stake 205 fits into typically has at least 1/16th inch clearance for a metal stake 205 made of 5/8 rebar, and may be larger in diameter than metal stake 205 by 1/8 inch or more.

The stake driver attachment 403 may have a circular cross-section, or may have a cut-away portion to produce a flattened side as shown by the end view 403-1 of the stake driver attachment 403. In FIG. 4 the flattened side of stake driver attachment 403 has been cut away to produce a notch that has a width narrower than the metal stake 205. The notch is narrower than metal stake 205 to avoid having the stake slip out of the notch as it is being driven into the ground. The flattened side of stake driver attachment 403 allows it to be used for driving stakes for the outer concrete form 104. By providing a flattened side the stake driver attachment 403 can be operated closer to the form 104 so the driven metal stake 205 will be immediately adjacent rather than 0.25 inch away.

The stake driver 401 and stake driver attachment 403 have a height adjustment gauge 405. On the jobsite a string may be stretched taut between two stakes for use as a reference for use with the height adjustment gauge 405 in order to drive the stakes 205 into the ground to the proper height to ensure the screed rail 201 is level. The string is typically positioned parallel to the surface of the concrete floor to be poured. The string may be level with the floor, or offset by a predefined height, e.g., 6 inches higher than the floor, 8 inches higher, etc. The height adjustment gauge 405 is adjusted so that the metal stake 205 is at the correct height when the gauge 405 reaches the string. In this way, the worker can quickly work his way along the string, driving the stakes 205 down to the correct height based on the level of the reference string.

A "wall captured concrete pour" occurs in the situation where concrete is poured between a concrete form on one side and a barrier such as a wall on the other side—e.g., form 104 and wall 102 of FIG. 1A. However, the barrier need not be a wall. For example, a "wall captured concrete pour" occurs when a form is used on one side and the barrier on the other side is a curb, a building foundation, a fence, the side of a ditch, or any other barrier that prevents use of a concrete form that serves as a screed rail as are known by those of ordinary skill in the art. The phrase "metal stake" has been used throughout the disclosure—i.e., metal stake 205. In practice the metal stake need not be made of metal, and can instead be implemented with polymer, hardwood, plastic or any other sufficient stiff and durable material known by those of ordinary skill in the art for use as stakes.

The term "receive" is used herein in the situation where one part is configured to be received into a portion of another part. For example, the rail support 203 is configured to receive a cross-section of the screed rail 201. In this context the phrase "configured to receive" means that the rail support 203 is shaped so that a cross-section of the screed rail 201 fits into it. As used herein, one part is received into another part if it fits at least one-third of the way into the other part. That is, it fits at least one-third of the way into the part based on the dimension being fit in—i.e., the diameter of the screed rail 201's cross-section. The phrase "removably receives" means that one part can be fit into (that is, fit at least one third of the way into) the other part and then be removed without requiring tools for the removal or damaging either part. A glove removably receives a hand, but a board does not removably receive a nail. The phrase "defines a level" is used herein to mean that the defined level is the same as whatever is used to define it. For example, the top edge of the screed rail defines the level of the screeded concrete surface. This means that the level of the screeded concrete surface will be the same as the level of the top edge of the screed rail (assuming a straight screed bar is run along the screed rail).

The phrase "slightly larger" as used herein means at least 1% greater than the dimension being referred to but no more than 20% greater. For example, a stake holder with an inner diameter slightly larger than the diameter of the stake means that the stake holder inner diameter is at least 1% larger than the diameter of the stake that fits in it but no greater than 20% larger. The phrase "fits loosely" is used herein to describe how one hollow part fits over another inserted part—e.g., how a hollow cylinder fits over a rod. The phrase "fits loosely" means that the inserted part fits within the hollow part with at least another 10% the dimension of the inserted part to spare. For example, a 10 mm rod inserted into a hollow cylinder with an inside diameter of no less than 11.01 mm can be said to fit loosely since 11.01 mm is 10.1% larger than 10 mm.

What is claimed is:

1. A concrete screeding apparatus for screeding a wall captured concrete pour to produce a screeded concrete surface, the apparatus comprising:

a screed rail with a top edge that defines a level of the screeded concrete surface;

a rail support configured to receive a cross-section of the screed rail a stake base assembly including a stake holder and a base plate;

the stake holder of the stake assembly having an inner diameter;

the base plate of the stake assembly with an upper surface that supports the stake holder and a lower surface configured to sit on ground surface;

a female thread and a male thread for removably affixing the screed rail to a second thread rail; and a stake that fits into the stake holder.

2. The concrete screeding apparatus of claim 1, wherein the screed rail has a cross section with a cross-sectional width and cross-sectional thickness, the cross-sectional width being no more than three times greater than the cross-sectional thickness.

3. The concrete screeding apparatus of claim 1, wherein the stake has a diameter smaller than the inner diameter of the stake holder.

4. The concrete screeding apparatus of claim 1, wherein the rail support includes an inner surface profile that removably receives the screed rail.

5. The concrete screeding apparatus of claim 1, wherein the stake is a metal stake, the apparatus further comprising:

a stake attachment mechanism in contact with the metal stake.

6. The concrete screeding apparatus of claim 5, wherein the stake attachment mechanism comprises a hole with female threads and a bolt with male threads.

7. The concrete screeding apparatus of claim 6, wherein the metal stake is an iron rebar stake.

8. The concrete screeding apparatus of claim 1, wherein the female thread is configured as part of a female threaded end of the of the screed rail; and wherein the male thread is configured as part of a male threaded end of the screed rail that fits into the female threaded end.

9. The concrete screeding apparatus of claim 8, wherein the female threaded end and the male threaded end have acme threads.

10. The concrete screeding apparatus of claim 9, wherein the screed rail is a first screed rail, the male threaded end is a first male threaded end and the female threaded end is a first female threaded end, the apparatus further comprising:

a second screed rail including a second female threaded end configured to removably attach to the first male threaded end of the first screed rail.

11. The concrete screeding apparatus of claim 10, further comprising:

a first hex cross-section portion on the first screed rail; and a second hex cross-section portion on the second screed rail.

12. The concrete screeding apparatus of claim 1, further comprising:

a stake driver attachment driven by a stake driver and configured to receive the stake, the stake driver attachment having an attachment length.

13. The concrete screeding apparatus of claim 12, wherein the stake driver attachment has a flattened side along a portion of the attachment length, the flattened side having a notch with a width of less than a diameter of the stake.

* * * * *